US008592670B2

(12) United States Patent
Gehring et al.

(10) Patent No.: US 8,592,670 B2
(45) Date of Patent: Nov. 26, 2013

(54) POLYPHONIC NOTE DETECTION

(71) Applicant: Apple Inc., Cupertino, CA (US)

(72) Inventors: Steffen Gehring, Hamburg (DE); Markus Sapp, Appen (DE); Pierre Fournier, Hamburg (DE)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/671,507

(22) Filed: Nov. 7, 2012

(65) Prior Publication Data

US 2013/0061735 A1 Mar. 14, 2013

Related U.S. Application Data

(63) Continuation of application No. 12/758,675, filed on Apr. 12, 2010, now Pat. No. 8,309,834.

(51) Int. Cl.
*G10H 1/00* (2006.01)

(52) U.S. Cl.
USPC ..... 84/616; 84/609; 84/615; 84/649; 84/653; 84/654; 84/477 R

(58) Field of Classification Search
None
See application file for complete search history.

(56) References Cited

U.S. PATENT DOCUMENTS

| | | | | |
|---|---|---|---|---|
| 5,210,366 | A * | 5/1993 | Sykes, Jr. | 84/616 |
| 6,124,544 | A | 9/2000 | Alexander et al. | |
| 6,140,568 | A | 10/2000 | Kohler | |
| 6,525,255 | B1 | 2/2003 | Funaki | |
| 6,725,108 | B1 | 4/2004 | Hall | |
| 6,894,212 | B2 | 5/2005 | Capano | |
| 7,003,120 | B1 | 2/2006 | Smith et al. | |
| 7,301,092 | B1 | 11/2007 | McNally et al. | |
| 7,465,866 | B2 | 12/2008 | Ueki et al. | |
| 7,485,797 | B2 | 2/2009 | Sumita | |
| 7,598,447 | B2 * | 10/2009 | Walker et al. | 84/616 |
| 7,674,970 | B2 | 3/2010 | Ma et al. | |
| 7,714,222 | B2 * | 5/2010 | Taub et al. | 84/600 |
| 8,008,566 | B2 * | 8/2011 | Walker et al. | 84/609 |
| 8,093,484 | B2 * | 1/2012 | Walker et al. | 84/603 |
| 8,309,834 | B2 * | 11/2012 | Gehring et al. | 84/613 |
| 2001/0045153 | A1 | 11/2001 | Alexander et al. | |
| 2002/0035915 | A1 | 3/2002 | Tolonen et al. | |

(Continued)

OTHER PUBLICATIONS

Godsill, Simon et al., "Bayesian Computational Models for Inharmonicity in Musical Instruments", *2005 IEEE Workshop on Applications of Signal Processing to Audio and Acoustics*, Oct. 16-19, 2005, New Paltz, NY, pp. 283-286.

*Primary Examiner* — Marlon Fletcher
(74) *Attorney, Agent, or Firm* — Blakely, Sokoloff, Taylor & Zafman LLP

(57) ABSTRACT

Processor-implemented methods and systems for polyphonic note detection are disclosed. The method includes converting a portion of a polyphonic audio signal from a time domain to a frequency domain. The method includes detecting a fundamental frequency peak in the frequency domain. The method then detects a defined number of integer-interval harmonic partials. If a defined number of integer-interval harmonic partials relative to the fundamental frequency peak are detected the fundamental frequency is recorded as a detected note. This process is repeated for each fundamental frequency until each note in the polyphonic audio signal has been detected. For example, this method allows detection of each note in a strummed guitar chord to provide feedback on the tuning of each string in a strummed chord or allows detection and feedback of the timing and pitch errors for guitar chords played along with a reference track.

18 Claims, 4 Drawing Sheets

(56) References Cited

U.S. PATENT DOCUMENTS

| | | | | |
|---|---|---|---|---|
| 2003/0026436 | A1 | 2/2003 | Raptopoulos et al. | |
| 2006/0143000 | A1 | 6/2006 | Setoguchi | |
| 2006/0204019 | A1* | 9/2006 | Suzuki et al. | 381/92 |
| 2008/0202321 | A1 | 8/2008 | Goto et al. | |
| 2008/0223202 | A1 | 9/2008 | Shi | |
| 2009/0282966 | A1* | 11/2009 | Walker et al. | 84/616 |
| 2010/0000395 | A1* | 1/2010 | Walker et al. | 84/616 |
| 2010/0037755 | A1 | 2/2010 | McMillen et al. | |
| 2010/0307321 | A1 | 12/2010 | Mann et al. | |
| 2010/0319517 | A1 | 12/2010 | Savo et al. | |
| 2011/0011243 | A1 | 1/2011 | Homburg | |
| 2011/0011244 | A1 | 1/2011 | Homburg | |
| 2011/0011245 | A1 | 1/2011 | Adam et al. | |
| 2011/0247480 | A1* | 10/2011 | Gehring et al. | 84/613 |
| 2011/0303075 | A1 | 12/2011 | McMillen | |
| 2012/0180618 | A1* | 7/2012 | Rutledge et al. | 84/610 |
| 2012/0294457 | A1* | 11/2012 | Chapman et al. | 381/98 |
| 2012/0294459 | A1* | 11/2012 | Chapman et al. | 381/98 |

* cited by examiner

POLYPHONIC NOTE DETECTION

This application is a continuation of co-pending U.S. patent application Ser. No. 12/758,675, filed on Apr. 12, 2010, entitled "POLYPHONIC NOTE DETECTION".

FIELD

The following relates to note detection, and more particularly to polyphonic note detection.

BACKGROUND

In general, sounds can be monophonic or polyphonic. Monophonic sounds emanate from a single voice. Examples of instruments that produce a monophonic sound are a singer's voice, a clarinet, and a trumpet. Polyphonic sounds emanate from groups of voices. For example, a guitar can create a polyphonic sound if a player excites multiple strings to form a chord. Other examples of instruments that can create a polyphonic sound include a chorus of singers, or a quartet of stringed instruments.

Known methods can analyze a monophonic sound, such as indicating tuning for a single guitar string or providing teaching playback assessment, such as timing and pitch errors, for a monophonic instrument played along with a reference track.

However, current methods do not detect notes within a polyphonic sound, for example, to allow the tuning of all strings of a guitar with a single strum or provide teaching playback assessment for polyphonic sounds, such as guitar chords, played along with a reference track. Therefore, users could benefit from an improved method and system for detecting individual notes in a polyphonic sound such as a strummed guitar chord.

SUMMARY

Processor-implemented methods and systems for polyphonic note detection are disclosed. The method includes converting a portion of a polyphonic audio signal from a time domain to a frequency domain. The method includes detecting a fundamental frequency peak in the frequency domain. The method can include detecting the fundamental frequency peak by scanning for a peak that exceeds a dB threshold, or the method can include searching for the fundamental frequency peak by searching for a peak at a frequency corresponding to a reference note. The method then detects a defined number of integer-interval harmonic partials. If a defined number of integer-interval harmonic partials relative to the fundamental frequency peak are detected, the fundamental frequency is recorded as a detected note. This process is repeated for each fundamental frequency until each note in the polyphonic audio signal has been detected. For example, this method allows detection of each note in a strummed guitar chord. The individual notes of the guitar chord can be compared to reference notes for tuning purposes, or the individual notes of the guitar chord can be compared to reference notes in a score for providing feedback to a user attempting to play along with the score.

Many other aspects and examples will become apparent from the following disclosure.

BRIEF DESCRIPTION OF THE DRAWINGS

In order to facilitate a fuller understanding of the exemplary embodiments, reference is now made to the appended drawings. These drawings should not be construed as limiting, but are intended to be exemplary only.

DETAILED DESCRIPTION

The method for detecting notes in polyphonic audio described herein can be implemented on a computer. The computer can be a data-processing system suitable for storing and/or executing program code. The computer can include at least one processor that is coupled directly or indirectly to memory elements through a system bus. The memory elements can include local memory employed during actual execution of the program code, bulk storage, and cache memories that provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data-processing systems or remote printers or storage devices through intervening private or public networks. Modems, cable modems, and Ethernet cards are just a few of the currently available types of network adapters. In one or more embodiments, the computer can be a desktop computer, laptop computer, or dedicated device.

Figure 1:
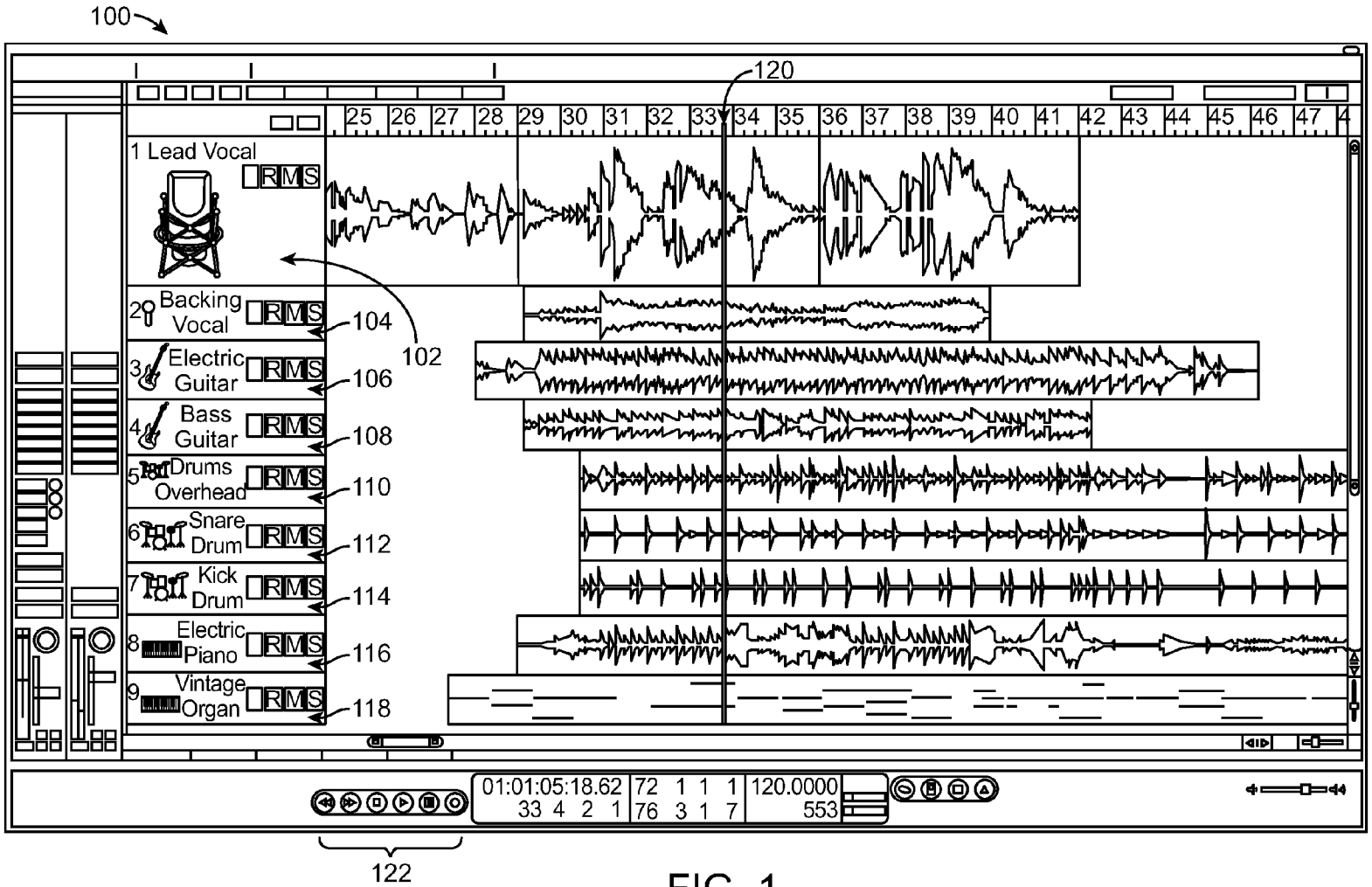
FIG. 1 illustrates a musical arrangement including MIDI and audio tracks.

FIG. 1 illustrates a musical arrangement as displayed on a digital audio workstation (DAW) including MIDI and audio tracks. The musical arrangement 100 can include one or more tracks, with each track having one or more audio files or MIDI files. Generally, each track can hold audio or MIDI files corresponding to each individual desired instrument in the arrangement. As shown, the tracks can be displayed horizontally, one above another. A playhead 120 moves from left to right as the musical arrangement is recorded or played. The playhead 120 moves along a timeline that shows the position of the playhead within the musical arrangement. The timeline indicates bars, which can be in beat increments. A transport bar 122 can be displayed and can include command buttons for playing, stopping, pausing, rewinding, and fast-forwarding the displayed musical arrangement. For example, radio buttons can be used for each command. If a user were to select the play button on transport bar 122, the playhead 120 would begin to move along the timeline, e.g., in a left-to-right fashion.

FIG. 1 illustrates an arrangement including multiple audio tracks including a lead vocal track 102, backing vocal track 104, electric guitar track 106, bass guitar track 108, drum kit overhead track 110, snare track 112, kick track 114, and electric piano track 116. FIG. 1 also illustrates a MIDI vintage organ track 118, the contents of which are depicted differently because the track contains MIDI data and not audio data.

Each of the displayed audio and MIDI files in the musical arrangement, as shown in FIG. 1, can be altered using a graphical user interface. For example, a user can cut, copy, paste, or move an audio file or MIDI file on a track so that it plays at a different position in the musical arrangement. Additionally, a user can loop an audio file or MIDI file so that it can be repeated; split an audio file or MIDI file at a given position; and/or individually time-stretch an audio file.

Figure 2:
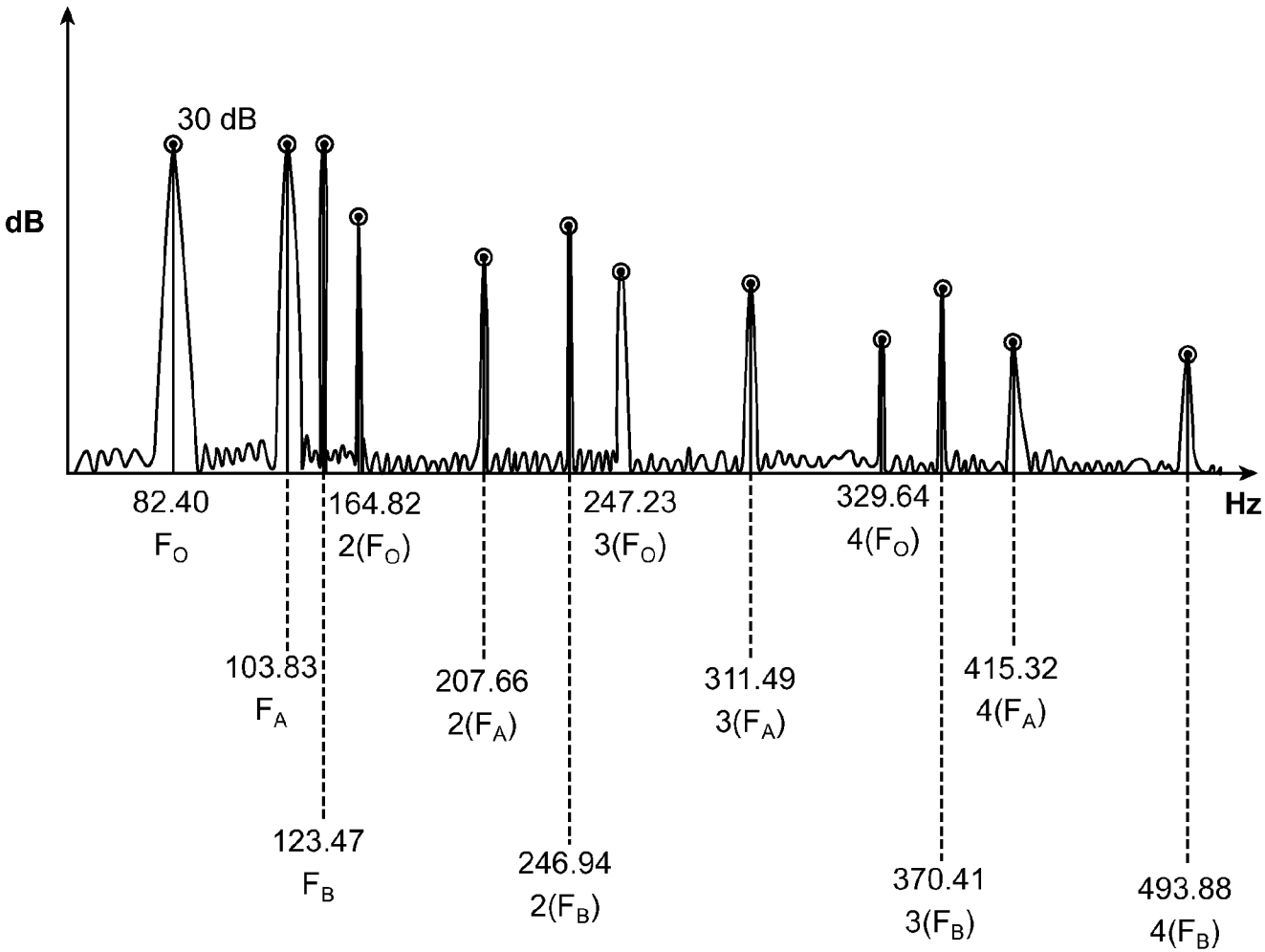
FIG. 2 illustrates a polyphonic sound as displayed in a frequency domain.

FIG. 2 illustrates a frequency domain view for a portion of a polyphonic audio stream. A system, as described herein, can convert the portion of the polyphonic audio stream from a time domain representation to a frequency domain representation by using a Fast Fourier Transform. Other methods of transforming an audio signal from a time domain representation to a frequency domain representation can be used to achieve this result. FIG. 2 displays Hertz (Hz) along the x-axis and dB along the y-axis. FIG. 2 corresponds to a user strumming an E chord with 3 strings on a standard tuned guitar along with a reference chord. The reference chord can be contained in a lesson that the user plays along with. In one example, the user strums an E chord along with a reference E chord. The reference E chord contains 3 MIDI notes, E2, G#2, and B2 that form an E major chord.

The system detects a peak at F0 a fundamental frequency. In one example, the system assigns the peak at F0 as a fundamental frequency because it exceeds a set value, such as 30 dB. Other set values or criteria can be defined to determine when a peak should be assigned as a fundamental frequency.

In one example, an assigned fundamental frequency F0 is initially referred to as a fundamental frequency candidate. In this nomenclature, a fundamental frequency thesis then exists. If a defined number of integer-interval harmonic partial peaks are detected relative to the fundamental frequency candidate, the fundamental frequency is recorded as a detected note in the polyphonic sound. Once a fundamental frequency is recorded as a detected note, the fundamental frequency thesis is proven. If the fundamental frequency is not recorded as a detected note, for example because not enough integer-interval harmonic partial peaks were detected, the fundamental frequency thesis was not proven.

In one embodiment, the system detects the first peak and defines it as an F0 candidate. Other peaks must be related to this peak with certain conditions, such as being integer-intervals, to prove the F0 thesis. If the F0 thesis is proven, the F0 frequency is recorded as a detected note.

The frequency of each related peak must be an integer or close to an integer-interval in defined error limits. In other words the related peaks must be integer-intervals, while still allowing for a tolerance in variation such as 2%. The slight deviation from a perfect integer-interval of each peak can be tracked and used as a reference for inharmonicity of a polyphonic audio signal. The measured inharmonicity can help to find the subsequent peaks in a more robust way. For example, if a peak is detected at a frequency 1.5% more than an exact integer interval, the detection can then begin its peak search at 1.5% more than an exact integer intervals for subsequent peaks.

In this example, the inharmonicity can not exceed a certain limit (e.g. 3%). Furthermore in this example, the peak amplitudes must exceed a level in relation to the F0 candidate amplitude (e.g. 30 dB range). A certain number of further related peaks must fulfill the criteria to define a group of peaks in order to prove the F0 thesis. This process of proving an F0 thesis is repeated for every fundamental frequency peak in a frequency band of interest. So, in this embodiment, each peak satisfying pre-defined criteria is a F0 candidate and the F0 frequency is recorded as a detected note if enough partial frequency peaks fulfilling the above criteria are detected. The number of partial frequency peaks required can be pre-defined to improve accuracy and performance.

In another example, the system can look up or identify a peak at a fundamental frequency from a stored value corresponding to a reference note. For example, a stored E2 MIDI note contains a frequency value of 82.41 Hz. The stored MIDI note can correspond to a score that a user is playing along with to learn a song. Based on this lookup the system will search for a peak at 82.41 Hz and assign a peak of sufficient amplitude as a fundamental frequency. As shown, in FIG. 2, the system detects a fundamental frequency F0 at 82.41 Hertz. In a preferred embodiment, the system allows a +−2% tolerance when searching for peaks. For example, the system will search for a peak at 82.41 Hz within a +−2% tolerance for a fundamental frequency peak.

In this example, the system now determines if there are three peaks at integer-interval harmonic frequency of the fundamental frequency F0. These three peaks can also be referred to as harmonic partials. The system finds a sufficient first peak at an integer-interval harmonic frequency 2(F0), or 164.80 Hz. The system finds a sufficient second peak at an integer-interval harmonic frequency 3(F0), or 247.2 Hz. The system finds a sufficient third peak at an integer-interval harmonic frequency 4(F0), or 329.6 Hz. Each peak can be deemed sufficient because it exceeds a set amplitude threshold, such as 10 dB.

Because the system has now found three peaks at integer-interval harmonic frequencies of the fundamental frequency, the presence or existence of a note corresponding to F0 (82.41 Hz) is stored in a computer memory. The presence or existence of this note can be stored as a MIDI value that indicates an E2 note is present in the polyphonic audio signal.

The system can now proceed to identify other notes present in the polyphonic audio signal portion shown in FIG. 2.

The system can look up or identify a peak at a fundamental frequency from a stored value corresponding to a reference note. For example, a stored G#2 MIDI note contains a frequency value of 103.83 Hz. The stored MIDI note can correspond to a score that a user is playing along with to learn a song. Based on this lookup the system will search for a peak at 103.83 Hz and assign a peak of sufficient amplitude as a fundamental frequency. As shown, the system detects a fundamental frequency FA at 103.83 Hz. In a preferred embodiment, the system allows a +−2% tolerance when searching for peaks. This frequency tolerance can be referred to as a frequency band or range. For example, the system will search for a peak at 103.83 Hz within a +−2% tolerance for a fundamental frequency peak.

The system now determines if there are three peaks at integer-interval harmonic frequency of the fundamental frequency FA. These three peaks can also be referred to as harmonic partials. The system finds a sufficient first peak at an integer-interval harmonic frequency 2(FA), or 207.66 Hz. The system finds a sufficient second peak at an integer-interval harmonic frequency 3(FA), or 311.49 Hz. The system finds a sufficient third peak at an integer-interval harmonic frequency 4(FA), or 415.32 Hz.

Because the system has now found three peaks at integer-interval harmonic frequencies of the fundamental frequency FA, the presence or existence of a note corresponding to FA (103.83 Hz) is stored in a computer memory. The presence or existence of this note can be stored as a MIDI value that indicates a G#2 note is present in the polyphonic audio signal.

The system can now proceed to identify a third note present in the polyphonic audio signal portion shown in FIG. 2.

The system can look up or identify a peak at a fundamental frequency from a stored value corresponding to a reference note. For example, a stored B2 MIDI note contains a frequency value of 123.47 Hz. The stored MIDI note can correspond to a score that a user is playing along with to learn a song. Based on this lookup the system will search for a peak at 123.47 Hz and assign a peak of sufficient amplitude as a fundamental frequency. As shown, the system detects a fundamental frequency FB at 123.47 Hz. In a preferred embodiment, the system allows a +−2% tolerance when searching for peaks. For example, the system will search for a peak at 123.47 Hz within a +−2% tolerance for a fundamental frequency peak.

The system now determines if there are three peaks at integer-interval harmonic frequencies of the fundamental frequency FB. The system finds a sufficient first peak at an integer-interval harmonic frequency 2(FB), or 246.94 Hz. The system finds a sufficient second peak at an integer-interval harmonic frequency 3(FB), or 370.41 Hz. The system finds a sufficient third peak at an integer-interval harmonic frequency 4(FB), or 493.88 Hz.

Because the system has now found three peaks at integer-interval harmonic frequencies of the fundamental frequency FB, the presence or existence of a note corresponding to FB (123.47 Hz) is stored in a computer memory. The presence or existence of this note can be stored as a MIDI value that indicates a B2 note is present in the polyphonic audio signal.

Therefore, the system detects notes in the polyphonic audio signal potion shown in FIG. 2. These three detected notes, E2 G#2 and B2 indicate that a user played an E major chord. If the user was playing along with a score or other teaching method, the system can indicate to the user that the E major chord was successfully played and provide positive feedback to the user.

In a preferred embodiment, this process is repeated to assist accuracy of note determination. Therefore, the system will now convert a second portion of the audio signal from a time domain to a frequency domain. The system will repeat the note detection process described above. If a previously detected note is not detected in the repeat analysis of the second portion, this system can erase the computer memory indicating a presence or existence of this note. In one example, once the system detects a note in a first portion of an audio signal, the system can reduce the number of detected peaks of integer-interval harmonic frequencies required to maintain the memory storage of a detected note in subsequent portions of the audio signal. This allows a detected note to be "sticky" and remain detected in subsequent iterations of the method even though the number of integer-interval harmonic frequency peaks for each fundamental frequency can vary.

In one example, the system engages the detection process every 256 samples for a digital audio signal recorded at CD quality (44,100 samples per second). This leads to the detection process engaging every 5.80 milliseconds.

Figure 3:
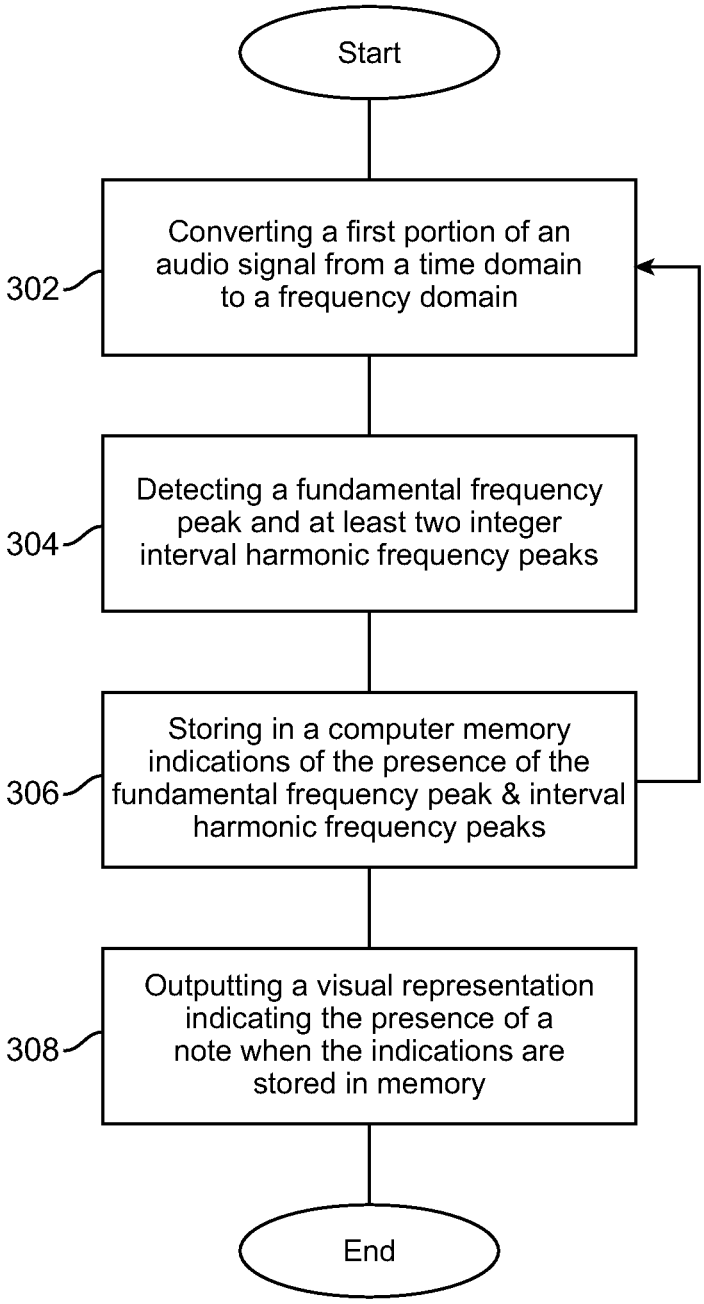
FIG. 3 is a flowchart for polyphonic note detection in a frequency domain.

The method for detecting notes in a polyphonic audio signal as described above may be summarized by the flowchart shown in FIG. 3. As shown in block 302, the method includes converting a first portion of the audio signal from a time domain to a frequency domain.

As shown in block 304, the method includes detecting a peak at a fundamental frequency and at least two peaks at integer-interval harmonic frequencies of the fundamental frequency. In one example, the method includes detecting a peak at a fundamental frequency when the amplitude of the peak is at least a predetermined value of 30 dB in the frequency domain. In another example, the method includes detecting a peak at a fundamental frequency equivalent to the frequency of a reference note. The reference note frequency can be identified by retrieving a value stored in MIDI data for the reference note.

In one example, detecting a peak at a fundamental frequency allows for detecting the peak within a +−2% Hz range. This range can be referred to as a predefined frequency band that includes the fundamental frequency. This range allows for the detection of notes that are not perfectly in tune.

Similarly, detecting a peak harmonic frequency can be done within a +−2% Hz range. The range can be referred to as a predefined frequency band including the harmonic frequency. This range also allows for the detection of peaks within a range of a selected frequency value.

As shown at block 306, the method includes storing, in a computer memory, indications of the existence of the fundamental and harmonic peaks.

The method can include repeating the note detection process for a second portion of the audio signal. The repetition of this method can provide more accuracy by only detecting notes that are present in multiple portions from the audio signal. The first portion can be the first 256 samples of a digital audio stream at CD quality and the second portion can be the next 256 samples of a digital audio stream at CD quality. CD quality audio contains 44,100 samples per second.

This repetition can include converting a second portion of the audio signal to a second frequency domain portion. In this example, determining the existence of the note further includes detecting in the second portion of the audio signal a peak at a fundamental frequency and at least one peak at an integer-interval harmonic frequency of the fundamental frequency. In this example, the number of detected harmonic frequency peaks required for note detection varies. Two harmonic frequency peaks are required in the first portion, but only one harmonic peak is required in the second portion to verify the presence or existence of a note. This allows the required number of detected harmonic frequency peaks to vary with portions of the audio signal. In one example, the number of required detected harmonic frequency peaks goes down after a note is detected in a portion of the audio signal.

A shown at block 308, the method includes outputting to a user a visual representation indicating the presence of the note in the audio signal when the indications are stored in the memory. The note corresponds to the frequency of the fundamental frequency.

Another example method detects three notes that form a chord in a polyphonic audio signal. The method includes converting a first portion of the audio signal from a time domain to a first frequency domain portion. The method includes determining the existence of a first note of the chord by detecting in the frequency domain portion a peak at a first fundamental frequency and at least one peak at an integer-interval harmonic frequency of the first fundamental frequency. The method then includes determining the existence of a second note of the chord by detecting in the frequency domain portion a peak at a second fundamental frequency and at least one peak at an integer-interval harmonic frequency of the second fundamental frequency. This example method includes determining the existence of a third note of the chord by detecting in the frequency domain portion a peak at a third fundamental frequency and at least one peak at an integer-interval harmonic frequency of the third fundamental frequency.

This example method for detecting three notes that form a chord in a polyphonic audio signal includes storing in a computer memory an indication of the existence of the first, second, and third notes. The method further includes outputting to a user a visual representation indicating the presence of the chord in the audio signal portion when the indication is stored in the memory.

In one implementation of the example method, a peak frequency is determined to exist when its amplitude in the frequency domain portion is at least a predetermined value of 30 dB. This allows a system to sweep across the frequency spectrum and tag any peaks that exceed a predetermined value such as 30 dB as a fundamental frequency peak. In other implementations, other amplitude threshold values can be chosen, such as 20 dB.

In another implementation of the example method, the first, second, and third fundamental frequencies are identified by retrieving values corresponding to a first, second, and third reference note. In this implementation, a system can look for a frequency peak at a defined fundamental frequency corresponding to a reference MIDI note. This can create a more robust detection because the system searches for peaks at defined frequencies in addition to sweeping across an entire frequency spectrum.

This approach, of using multiple peak detection methods to provide more robust detection, can allow the system to verify or prove that a requested note was played by analyzing the spectrum for existing peaks related to a reference MIDI note. The reference MIDI note is transformed into a F0 frequency. The spectrum is searched for this F0 frequency and a defined number of required related integer peaks.

In certain circumstances, for example due to the nature of an instrument or the way a note is played, a fundamental frequency F0 can be missing or weak compared to its related integer frequency partials. In such a circumstance, a system can detect a played note with a missing or weak fundamental frequency by using fundamental frequency estimation. Fundamental frequency estimation can work by estimating a fundamental frequency based on a defined number of detected integer-interval partials even when a fundamental frequency is missing or weak. The spectrum of an audio signal can then be searched with the fundamental frequency estimation. In such a case, an audio signal is then searched in three manners, i.e. by sweeping across an entire frequency spectrum; by searching for a fundamental frequency with related partials at frequencies related to a reference note; and by searching at frequencies estimated to be fundamental frequencies based on detected partials even when a fundamental frequency is missing or weak. This embodiment can make the spectrum match more robust.

This example method can include searching for fundamental frequency peaks and harmonic frequency peaks within tolerance ranges. In this implementation, a peak fundamental frequency is determined to exist if a peak is detected within a predefined frequency band including the fundamental frequency. Similarly, a peak harmonic frequency is determined to exist if a peak is detected within a predefined frequency band including the harmonic frequency.

The method can include the requirement of more than one peak at integer-interval harmonics for a note to be stored as present. For example, the method can require at least two peaks at integer-interval harmonic frequencies of the first fundamental frequency. In another example, the method can require three peaks at integer-interval harmonic frequencies.

The method of detecting three notes that form a chord in a polyphonic signal can include converting a second portion of the audio signal to a second frequency domain portion. After converting the second portion of the audio signal, the method can include determining the existence of the first note of the chord, when the at least two peaks were detected in the first frequency domain portion, detecting in the second frequency domain portion of the audio signal a peak at a first fundamental frequency and at least one peak at an integer-interval harmonic frequency of the first fundamental frequency. This changes the required integer-interval harmonic frequency peaks from two in the first portion to one in the second portion.

Figure 4:
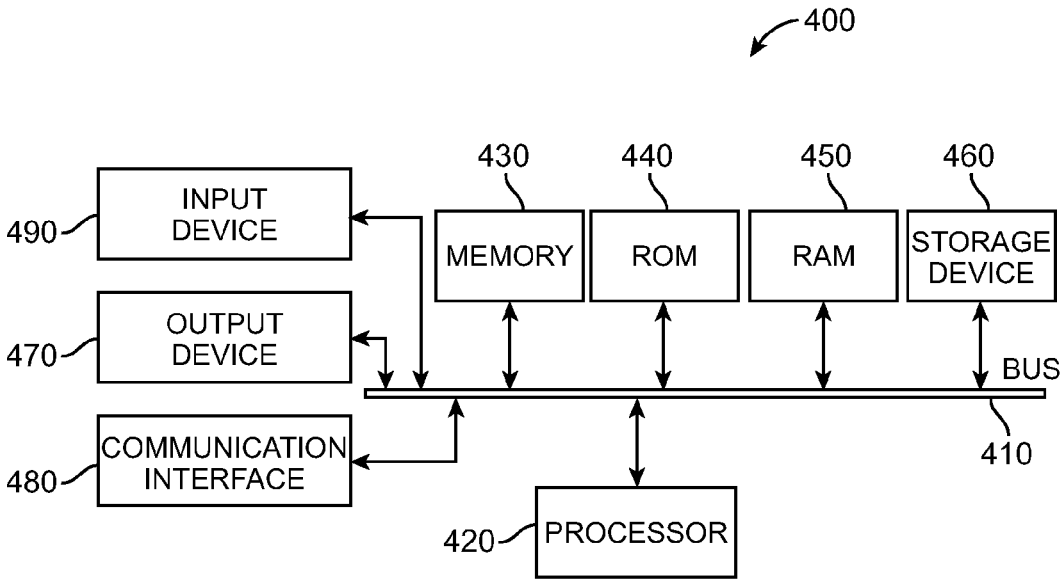
FIG. 4 illustrates hardware components associated with a system embodiment.

FIG. 4 illustrates the basic hardware components associated with the system embodiment of the disclosed technology. As shown in FIG. 4, an exemplary system includes a general-purpose computing device 400, including a processor, or processing unit (CPU) 420 and a system bus 410 that couples various system components including the system memory such as read only memory (ROM) 440 and random access memory (RAM) 450 to the processing unit 420. Other system memory 430 may be available for use as well. It will be appreciated that the invention may operate on a computing device with more than one CPU 420 or on a group or cluster of computing devices networked together to provide greater processing capability. The system bus 410 may be any of several types of bus structures including a memory bus or memory controller, a peripheral bus, and a local bus using any of a variety of bus architectures. A basic input/output (BIOS) stored in ROM 440 or the like, may provide the basic routine that helps to transfer information between elements within the computing device 400, such as during start-up. The computing device 400 further includes storage devices such as a hard disk drive 460, a magnetic disk drive, an optical disk drive, tape drive or the like. The storage device 460 is connected to the system bus 410 by a drive interface. The drives and the associated computer readable media provide nonvolatile storage of computer readable instructions, data structures, program modules and other data for the computing device 400. The basic components are known to those of skill in the art and appropriate variations are contemplated depending on the type of device, such as whether the device is a small, handheld computing device, a desktop computer, or a computer server.

Although the exemplary environment described herein employs the hard disk, it should be appreciated by those skilled in the art that other types of computer readable media which can store data that are accessible by a computer, such as magnetic cassettes, flash memory cards, digital versatile disks, cartridges, random access memories (RAMs), read only memory (ROM), a cable or wireless signal containing a bit stream and the like, may also be used in the exemplary operating environment.

To enable user interaction with the computing device 400, an input device 490 represents any number of input mechanisms such as a microphone for an acoustic guitar, electric guitar, other polyphonic instruments, a touch-sensitive screen for gesture or graphical input, keyboard, mouse, motion input, speech and so forth. The device output 470 can also be one or more of a number of output mechanisms known to those of skill in the art, such as a display. In some instances, multimodal systems enable a user to provide multiple types of input to communicate with the computing device 400. The communications interface 480 generally governs and manages the user input and system output. There is no restriction on the disclosed technology operating on any particular hardware arrangement and therefore the basic features here may easily be substituted for improved hardware or firmware arrangements as they are developed.

For clarity of explanation, the illustrative system embodiment is presented as comprising individual functional blocks (including functional blocks labeled as a "processor"). The functions these blocks represent may be provided through the use of either shared or dedicated hardware, including but not limited to hardware capable of executing software. For example the functions of one or more processors shown in FIG. 4 may be provided by a single shared processor or multiple processors. (Use of the term "processor" should not be construed to refer exclusively to hardware capable of executing software.) Illustrative embodiments may comprise microprocessor and/or digital signal processor (DSP) hardware, read-only memory (ROM) for storing software performing the operations discussed below, and random access memory (RAM) for storing results. Very large scale integration (VLSI) hardware embodiments, as well as custom VLSI circuitry in combination with a general purpose DSP circuit, may also be provided.

The technology can take the form of an entirely hardware-based embodiment, an entirely software-based embodiment, or an embodiment containing both hardware and software elements. In one embodiment, the disclosed technology can be implemented in software, which includes but may not be limited to firmware, resident software, microcode, etc. Furthermore, the disclosed technology can take the form of a computer program product accessible from a computer-usable or computer-readable medium providing program code for use by or in connection with a computer or any instruction execution system. For the purposes of this description, a computer-usable or computer-readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium (though propagation mediums in and of themselves as signal carriers may not be included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk, and an optical disk. Current examples of optical disks include compact disk read only memory (CD-ROM), compact disk read/write (CD-R/W), and DVD. Both processors and program code for implementing each as aspects of the technology can be centralized and/or distributed as known to those skilled in the art.

The above disclosure provides examples within the scope of claims, appended hereto or later added in accordance with applicable law. However, these examples are not limiting as to how any disclosed embodiments may be implemented, as those of ordinary skill can apply these disclosures to particular situations in a variety of ways.

We claim:

1. A computer-implemented method of detecting and identifying a note in an audio signal, comprising:

converting a first portion of the audio signal from a time domain to a first frequency domain portion;

detecting, in the first frequency domain portion, a peak at a fundamental frequency and detecting a first predetermined number of peaks at integer-interval harmonic frequencies of the fundamental frequency;

converting a second portion of the audio signal to a second frequency domain portion;

identifying the note by detecting, in the second frequency domain portion of the audio signal, a peak at the fundamental frequency and detecting a second predetermined number of peaks at integer-interval harmonic frequencies of the fundamental frequency, wherein the second predetermined number of peaks is less than the first predetermined number of peaks;

storing in a computer memory indications of the existence of the fundamental and harmonic peaks; and outputting to a user a visual representation indicating the presence of the note in the audio signal portion when the indications are stored in the memory.

2. The method of claim 1, wherein a peak frequency is determined to exist when its amplitude in the frequency domain portion is at least a predetermined value of 30 dB.

3. The method of claim 2, wherein the fundamental frequency is identified by retrieving a value corresponding to a reference note.

4. The method of claim 1, wherein a peak fundamental frequency is determined to exist if a peak is detected within a predefined frequency band including the fundamental frequency.

5. The method of claim 1, wherein a peak harmonic frequency is determined to exist if a peak is detected within a predefined frequency band including the harmonic frequency.

6. The method of claim 1, wherein the first predetermined number of peaks comprises at least two peaks, the second predetermined number of peaks comprises at least one peak, and wherein determining the existence of the note further comprises, when the at least two peaks were detected in the first frequency domain portion, detecting in the second frequency domain portion of the audio signal a peak at a fundamental frequency and at least one peak at an integer interval harmonic frequency of the fundamental frequency.

7. A system for detecting and identifying a note in an audio signal, comprising:

a processor configured to convert a first portion of the audio signal from a time domain to a first frequency domain portion; the processor configured to detect in the first frequency domain portion a peak at a fundamental frequency and to detect a first predetermined number of peaks at integer-interval harmonic frequencies of the fundamental frequency;

the processor configured to convert a second portion of the audio signal from a time domain to a second frequency domain portion;

the processor configured to determine the identity of the note by detecting, in the second frequency domain portion of the audio signal, a peak at the fundamental frequency and a second predetermined number of peaks, each peak at integer-interval harmonic frequencies of the fundamental frequency, wherein the second predetermined number of peaks is less than the first predetermined number of peaks;

the processor configured to store in a computer memory indications of the existence of the fundamental and harmonic peaks; and a display to output to a user a visual representation indicating the presence of the note in the audio signal portion when the indications are stored in the memory.

8. The system of claim 7, wherein a peak frequency is determined to exist when its amplitude in the frequency domain portion is at least a predetermined value of 30 dB.

9. The system of claim 8, wherein the fundamental frequency is identified by retrieving a value corresponding to a reference note.

10. The system of claim 7, wherein a peak fundamental frequency is determined to exist if a peak is detected within a predefined frequency band including the fundamental frequency.

11. The system of claim 7, wherein a peak harmonic frequency is determined to exist if a peak is detected within a predefined frequency band including the harmonic frequency.

12. The system of claim 7, wherein the first predetermined number of peaks comprises at least two peaks, the second predetermined number of peaks comprises at least one peak, and wherein the processor configured to determine the existence of the note is further configured to, when the at least two peaks were detected in the first frequency domain portion, detect in the second frequency domain portion of the audio signal a peak at a fundamental frequency and at least one peak at an integer-interval harmonic frequency of the fundamental frequency.

13. A tangible computer readable medium storing instructions for controlling a computing device to detect and identify a note in a polyphonic audio signal, the instructions comprising:

converting a first portion of the audio signal from a time domain to a first frequency domain portion;

detecting in the first frequency domain portion a peak at a fundamental frequency and detecting a first predetermined number of peaks at integer-interval harmonic frequencies of the fundamental frequency;

converting a second portion of the audio signal from a time domain to a second frequency domain portion;

identifying the note by detecting in the second frequency domain portion of the audio signal a peak at the fundamental frequency and detecting a second predetermined number of peaks at inter-interval harmonic frequencies of the fundamental frequency, wherein the second predetermined number of peaks is less than the first predetermined number of peaks; and storing in a computer memory indications of the existence of the fundamental and harmonic peaks; and outputting to a user a visual representation indicating the presence of the note in the audio signal portion when the indications are stored in the memory.

14. The computer readable medium of claim 13, wherein a peak frequency is determined to exist when its amplitude in the frequency domain portion is at least a predetermined value of 30 dB.

15. The computer readable medium of claim 13, wherein the fundamental frequency is identified by retrieving a value corresponding to a reference note.

16. The computer readable medium of claim 13, wherein a peak fundamental frequency is determined to exist if a peak is detected within a predefined frequency band including the fundamental frequency.

17. The computer readable medium of claim 13, wherein a peak harmonic frequency is determined to exist if a peak is detected within a predefined frequency band including the harmonic frequency.

18. The computer readable medium of claim 13, wherein the first predetermined number of peaks comprises at least two peaks, the second predetermined number of peaks comprises at least one peak, and wherein determining the existence of the note further comprises instructions to, when the at least two peaks were detected in the first frequency domain portion, detect in the second frequency domain portion of the audio signal a peak at a fundamental frequency and at least one peak at an integer-interval harmonic frequency of the fundamental frequency.

* * * * *